US006640479B2

(12) United States Patent
Gühring et al.

(10) Patent No.: US 6,640,479 B2
(45) Date of Patent: Nov. 4, 2003

(54) HAMMER RELEASE APPARATUS

(75) Inventors: Manfred Gühring, Oberndorf/Neckar (DE); Rudi Beckmann, Aichhalden (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 09/827,754

(22) Filed: Apr. 6, 2001

(65) Prior Publication Data

US 2001/0054246 A1 Dec. 27, 2001

Related U.S. Application Data

(63) Continuation of application No. PCT/EP99/07532, filed on Oct. 7, 1999.

(51) Int. Cl.[7] ..... F41A 3/00
(52) U.S. Cl. ..... 42/69.03; 42/70.06
(58) Field of Search ..... 42/69.03, 70.06, 42/70.08; 89/128, 129.01, 131, 140

(56) References Cited

U.S. PATENT DOCUMENTS

| | | | | |
|---|---|---|---|---|
| 2,399,253 A | | 4/1946 | Reilly | 42/69 |
| 3,045,555 A | | 7/1962 | Stoner | 89/142 |
| 3,292,492 A | | 12/1966 | Sturtevant | 89/128 |
| 3,301,133 A | | 1/1967 | Sturtevant | 89/131 |
| 3,345,914 A | | 10/1967 | Newcomb et al. | 89/129 |
| 3,626,621 A | | 12/1971 | Ido | 42/41 |
| 3,847,054 A | * | 11/1974 | Ruger et al. | 89/129.02 |
| 4,004,496 A | | 1/1977 | Snodgrass et al. | 89/129 |
| 4,523,509 A | | 6/1985 | Thevis et al. | 89/131 |
| 5,501,134 A | * | 3/1996 | Milazzo et al. | 42/69.03 |
| 5,713,150 A | * | 2/1998 | Ealovega | 42/84 |
| 5,913,261 A | | 6/1999 | Gühring et al. | 89/128 |
| 6,125,735 A | | 10/2000 | Gühring | 89/141 |
| 6,131,324 A | * | 10/2000 | Jewell | 42/69.03 |

FOREIGN PATENT DOCUMENTS

| | | | |
|---|---|---|---|
| AT | 295357 | 12/1971 | 89/128 |
| CH | 626717 | 11/1981 | |
| DE | 196 26 077 | 1/1998 | |
| DE | 196 43 377 | 4/1998 | |

OTHER PUBLICATIONS

European Patent Office *PCT International Search Report*, dated Jan. 21, 2000, in connection with PCT patent application Ser. No. PCT/EP99/07532, the parent of this application.

Translation of European Patent Office *PCT International Preliminary Examination Report*, dated Jun. 08, 2000, in connection with PCT patent application Ser. No. PCT/EP99/07532, the parent of this application.

* cited by examiner

*Primary Examiner*—Michael Carone
*Assistant Examiner*—M. Thomson
(74) *Attorney, Agent, or Firm*—Marshall, Gerstein & Borun LLP

(57) ABSTRACT

A hammer release apparatus for a hand held firearm which reduces the force required to discharge the firearm is disclosed which includes a hammer, a pivotably mounted trigger, and a restraining lever. The restraining lever engages the cocked hammer which is biased towards a firing position by a hammer spring. The restraining lever counteracts the force of the hammer spring to reduce the pull resistance associated with the trigger of the firearm.

13 Claims, 1 Drawing Sheet

HAMMER RELEASE APPARATUS

RELATED APPLICATION

This application continuation of priority under 35 U.S.C. §120 from PCT application Ser. No. PCT/EP99/07532, filed Oct. 7, 1999.

FIELD OF THE INVENTION

The present invention relates generally to firearms, and more particularly to a hammer release assembly for a hand-held weapon which allows for a reduced trigger-pull.

BACKGROUND OF THE INVENTION

Various hammer release assemblies are known in the firearm art. For example, a simple hammer release assembly may comprise a hammer, or striking element, a catch on the surface of the hammer, a hammer spring and a trigger which operatively engages the hammer catch either directly or through a trigger rod. The hammer is typically rotatable about an axis by force of the hammer spring and is biased to travel through a strike path from a cocked position to a firing/rest position, at which point the hammer may strike a firing pin to discharge a round from the firearm. The hammer may be held in the cocked position by the engagement of the trigger with the hammer catch and may be released therefrom by an operator activating the trigger.

During operation, the hammer is rotated to a cocked position against the force of the hammer spring. When the hammer reaches the cocked position, the hammer catch engages the trigger or trigger rod and, under force of the hammer spring, the surface of the hammer catch and the trigger are pressed together perpendicular to the direction of motion of the hammer. The action of pressing the hammer and the trigger together creates a friction force which, along with a component of the hammer spring force, must be overcome to release the hammer and allow the hammer to rotate to the firing position. By varying the position of the hammer catch and trigger or trigger rod, the amount of friction which must be overcome to fire the weapon can be similarly varied. By varying the amount of force necessary to discharge the firearm, differing trigger resistances can be realized.

A marksman who wishes to discharge the firearm must overcome a number of firing forces to complete the operation. Specifically, the marksman must overcome the release force which comprises the friction force between the hammer catch and trigger, the spring force which holds the trigger in the rest position, as well as the friction force which opposes the movement of the trigger, and in some cases, the friction local to the trigger rod.

Firearms may be used in many different situations, for example military, police, recreation, or competition. In the situation where the firearm is a high capacity sport weapon, the firing forces discussed above, should be minimized, since a weapon in this class is only loaded at a shooting range immediately before firing, and is loaded by a skilled marksman with extreme care. On the other hand, when the firearm is a military class weapon, extreme caution must be used in reducing the firing forces since the weapon is subject to many unusual situations. For example a military weapon may be jostled or thrown to the ground, a marksman may be hindered by wearing thick, clumsy gloves, or the weapon may be subject to harsh environmental factors such as mud and rain. The harsh conditions associated with military use make it necessary to maximize the firing forces. If, for instance, a military weapon falls from an elevated position, it will strike the ground with an increasing velocity and at varying angles, releasing impact forces on the trigger and trigger rod. To prevent the weapon from firing, the firing forces must be greater than the impact forces imparted under these circumstances. Therefore, military and police weapons necessarily have harder trigger-pulls (the force necessary to activate the weapon) than do sports weapons. Similarly, normal firearm usage such as hunting, military shooting sports, self-protection and recreational use have trigger-pulls which lie between those of military and sport use because the weapons are generally well cared for and yet still subject to varying environmental conditions.

Ignoring, for the moment, the use of additional apparatuses designed to ease the force required to pull the trigger, i.e., to attain a "hair trigger," a typical firearm used for normal firearm usage requires approximately 15 to 20 Newtons of force to discharge. Forces in this range are comfortable and are considered "soft" for an experienced marksman. Military firearms, however, can require up to 50 Newtons of force to cause discharge, while sport pistols may require as little as 0.3 Newtons.

In order to produce a civilian version of a military weapon, the trigger-pull on the military version cannot be simply reduced, if the intent is to produce a civilian version suitable for multiple uses, for example, military reserves, sports and hobbies. The reason is, that the spring forces and the angle of the contact surfaces between the catch and the trigger (or the trigger-rod) cannot, due to safety restraints, be changed at will beyond certain limits.

One way to reduce the friction force is by polishing and buffing the seating and contact surfaces. This technique, however, is expensive, time consuming, and vulnerable to error. Furthermore, the polished trigger is extremely sensitive to any light contaminate, such as air borne sand particles, which could nullify any reduction of friction force achieved by such polishing.

Another method of reducing the friction force is by inserting intermediate linkages, transmission levers and the like, between the trigger and the hammer. This method, however, is very complicated and often difficult to implement due to space limitations, cost of manufacture and design, and the craftsmanship skill required.

SUMMARY OF THE INVENTION

A hammer release apparatus is disclosed for use in a firearm for reducing a pull resistance associated with discharging the weapon. The apparatus includes a pivotably mounted hammer having a stop notch, and a projection. Operably connected to the hammer is a hammer spring for generating a rotational force biasing the hammer from a cocked position toward a firing position. The hammer release apparatus includes a trigger having an engagement nose at one end and a spring for biasing the trigger to a rest position. The trigger is actuatable, against a force of the trigger spring from a rest position into a depressed position for discharging the firearm. A pivotably mounted trigger lever is located to engage the stop of the hammer, and to engage the trigger engagement nose. A pivotably mounted restraining apparatus having a catch disposed to restrainingly engage the projection of the hammer is biased by a spring to generate a force counter to the rotational force of the hammer spring.

BRIEF DESCRIPTION OF THE DRAWING

The following detailed description makes reference to the drawing, a brief description of which is provided below.

DETAILED DESCRIPTION OF PREFERRED EXAMPLES

Figure 1:
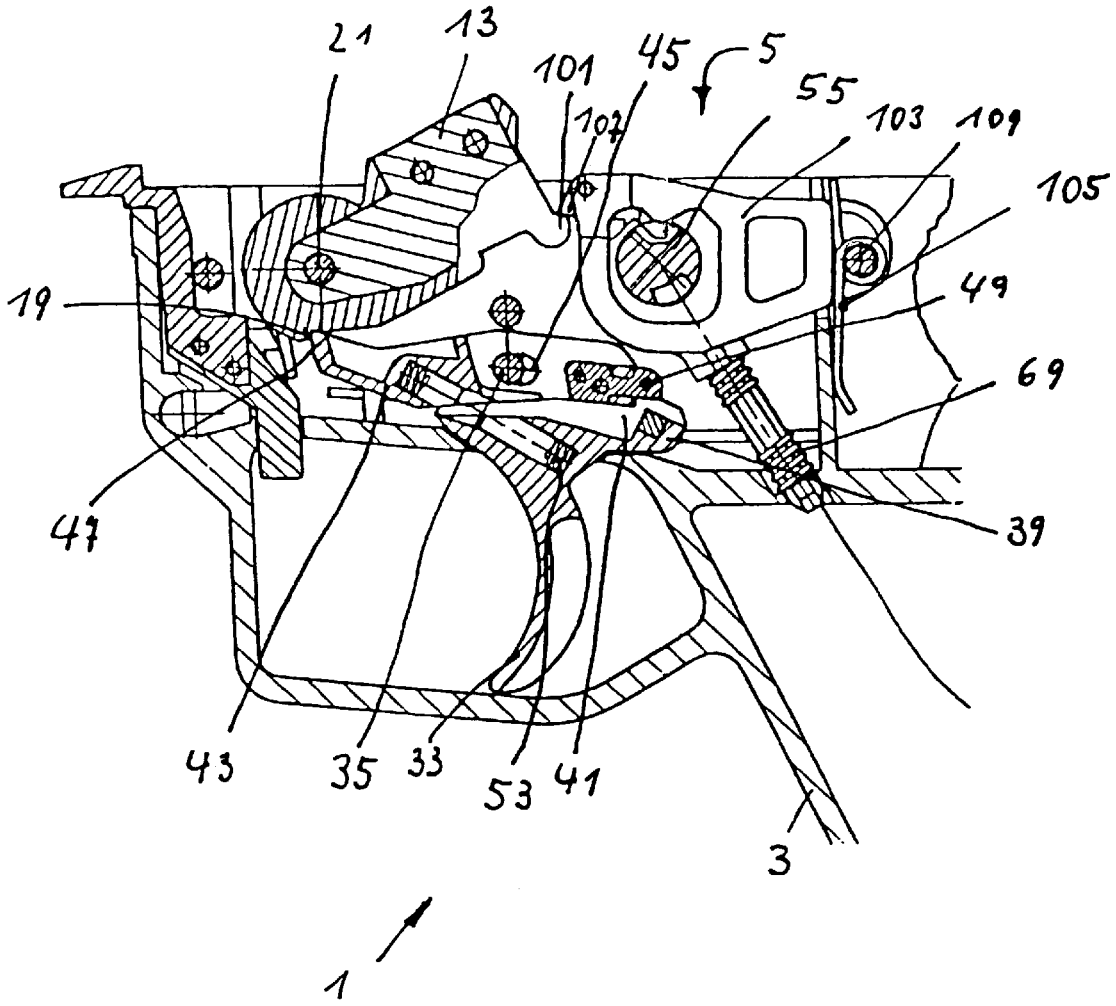
FIG. 1 is a longitudinal section through a firearm illustrating an exemplary hammer release assembly constructed in accordance with the teachings of the invention.

Generally, the disclosed hammer release assembly represents a civilian version of a known military trigger assembly. The entire trigger arrangement of this weapon in its military version is described in detail by the applicant in U.S. Pat. No. 5,913,261 which is hereby incorporated herein by reference for all purposes. As will be noted, however, the continuous fire operational capability of the military version has been omitted.

In both the figure and the description that follow, it should be understood that the firearm is horizontally disposed and pointed to the left (the direction of fire) and certain position designations such as "above," "forward," etc. are made with reference to a firearm in such position. Furthermore, in the present drawing, for all components, which agree with those of the known trigger apparatus, the same reference numbers have been used. All three digit reference numbers represent parts, which are new, in reference to the known military assembly.

As shown in FIG. 1, a trigger arrangement 5 may be situated in an assembly frame 1, which possesses a hand grip 3. In the present example, the assembly frame 1 and the hand grip 3 may be enclosed in a gun stock of plastic and constructed as one unit component.

A hammer 13 is rotatably mounted on a hammer shaft 21 and possesses a cleat type hammer stop notch 19, which, in the cocked position (as shown in the drawing), can be brought into engagement with a complementary engaging stop 47 described below. The hammer 13 is biased by a pair of hammer springs (not shown), which are disposed on either side of the hammer 13. The springs resemble clothespin springs and rotate the hammer 13 counter clockwise from the cocked position shown in FIG. 1 to a firing position (not shown).

A trigger 33 is rotatably mounted about a trigger axis 35 disposed rearward and beneath the hammer shaft 21. The trigger 33 has an actuating lever which passes downward through a slot formed in the assembly frame 1. The trigger 33 also has a main body recessed within the assembly frame 1. A security projection (not shown) extends upward from the trigger body.

The rear portion of the trigger body has a metal inlay which forms an engaging nose 39. The nose 39 provides a support for a trigger spring (not shown). The trigger spring is also constructed as a dual-shank clothespin spring and is seated with its spiral section on a lateral shaft stub formed on the trigger 33 and supported with one of its shanks on the bottom of the assembly frame 1. The trigger spring presses the trigger 33 into the position of FIG. 1, in which it is ready to be activated.

In the recess there is accommodated an elongated trigger lever 43 extending in the lengthwise direction of the weapon. The trigger lever 43 has an oblong bore 45, which receives the trigger axis 35. The oblong bore 45 is constructed as an oblong opening or slot so that the trigger lever 43 can be rotated to some degree, relative to the trigger 33, and can move in the longitudinal direction.

A blind bore is defined in both the trigger lever 43 and the trigger 33. A spiral trigger lever spring 53 is seated in the blind bore. The spiral trigger lever spring 53 runs obliquely from beneath the trigger axis 35 to bias the trigger lever 43 forward and upward relative to the trigger 33. The front portion of the trigger lever 43 forms the engaging stop 47 mentioned above.

The trigger lever 43 may occupy two operational positions. The first position, a ready-to-fire position, is illustrated in the drawing and shows the rear end 49 of the trigger lever 43 located above the engagement nose 39 of the trigger 33. In the second operational position, the fired position, the trigger 33 has been pulled and is in the retracted position while the trigger lever 43 is pressed forward by the trigger lever spring 53. The rear end 49 of the trigger lever 43 drops into a recess 41, which is defined by the upper side of the trigger 33 and the engagement nose 39.

From the rest position of the trigger 33 and trigger lever 43 shown in FIG. 1, the trigger lever 43, under the pressure of the trigger lever spring 53, is biased toward its forwardmost position. The hammer stop notch 19 engages the engaging stop 47 and in the process, under the load of the two percussion springs (not shown), presses the firing lever 43, against the action of the trigger lever spring 53, to the rear until the oblong bore 45 is seated with its front boundary on the trigger axis 35. A trigger lever free end 49 is above, but not in contact with, the upper surface of the trigger engagement nose 39.

If the trigger 33 is pulled when the hammer is in the ready-to-fire state shown in FIG. 1, (i.e., drawn to the rear for the delivery of a shot), then the trigger 33 moves along a free swinging path until the engagement nose 39 strikes the free end 49 of the trigger lever 43. If the trigger 33 continues to be drawn to the rear, the engagement nose 39 lifts the free end 49 of the trigger lever 43 upward, whereby the trigger lever rotates about trigger shaft 35. With the rotation of the trigger lever 43, the engaging stop 47 is rotated downward until the hammer stop notch 19 is released and the hammer 13 strikes. At the same time, the trigger spring lever 53 pushes the trigger lever 43 up and forward, and the free end 49 of the trigger lever 43 falls into the recess 41 so that the engaging stop 47 contacts the periphery of the hammer 13.

After the shot is fired, the hammer 13 is rotated clockwise and recocked by means of the returning breech action (not shown). Upon rotating, the hammer stop notch 19 rotates over the engaging stop 47 to the front and after reaching a dead point, the hammer 13 reverses its rotation, until the hammer stop notch 19 comes into engagement with the engaging stop 47. Once engaged, the hammer 13 is held in place just short of its cocked position. As the trigger 33 is loosed, the trigger 33 moves forward and the engagement nose 39 drops down below the free end 49 of the trigger lever 43. The trigger lever 43 is pushed to the rear by the hammer stop notch 19, until it reaches its rear end position as is shown in the drawing. In this position, the hammer 13 is once again in its fully cocked position.

Located behind and above the engagement nose 39 is a transverse safety shaft 55 which may assume different (here two) rotary positions and is held in place by a spring 69. On the rear side of the trigger 33 and laterally offset in relation to the engagement nose 39 is an integrated, safety extension (not seen in the drawing) which extends toward the outer circumference of the safety shaft 55.

When the safety shaft 55 is rotated into the "safety" position, the safety extension lies against the circumference of the safety shaft 55 or is located just beneath the rim. If the trigger 33 is pulled, the trigger 33 will not move, or will move only inconsequentially. If, however, the safety shaft 55 is rotated so that the upper end of the safety extension lies opposite a recess in the safety shaft 55, then when the trigger 33 is pulled, the safety extension will enter the recess and thereby allow the pivoting of the trigger 33 and consequentially, allow the firearm to discharge.

The above description of the hammer release assembly coincides with the trigger arrangement described in U.S. Pat. No. 5,913,261 and, as is customary with military weapons, describes a trigger-pull which is very high. As described below, however, the present example allows for the reduction of the trigger-pull while maintaining a high quality military construction.

In the illustrated example, the hammer 13 possesses a projection 101, which is similar to a hammer catch present on a revolver hammer. To the rear of the assembly frame 1 and on the same level as the safety shaft 55, is a restraining lever shaft 109 which is parallel to the hammer shaft 21. Rotatably mounted on the restraining lever shaft 109 is the rear end of a restraining lever 103. The shaft 109 also axially penetrates the eyes of two adjacent and similarly constructed restraining springs 105 (only one of which is depicted in FIG. 1), which resemble lock springs for a bolt.

The restraining springs 105 cause the retraining lever 103 to pivot about the restraining lever shaft 109 and cause the forward end of the restraining lever 103 to be pressed downward. The forward end of the restraining lever shaft 109 carries a catch 107, with a flat underside which, in the illustrated cocked position, engages and seats itself upon the projection 101 of the hammer 13. The restraining spring 105 attempts to rotate the hammer projection 101 and the hammer 13, downward. The hammer 13, however, cannot be so rotated downward, due to the force of the hammer springs, but the force which the hammer stop notch 19 exerts against the trigger lever 43, is diminished by the action of the restraining spring 105. Consequentially, with the reduced friction force between the trigger lever 43 and the hammer 13, the trigger 33 becomes easier to pull, that is, the trigger-pull is diminished.

As the trigger 33 is pulled, the hammer 13 is released, and the force of the firing pin spring, which acts against the hammer projection 101, counteracts the force of the restraining spring 105 holding the hammer projection 101. Under force of the firing springs, the restraining lever 103 pivots upwards about the shaft 109 allowing the hammer 13 to rotate along the strike path and fire the weapon. While the hammer 13 travels along the strike path, the restraining lever 103 returns to the position illustrated in the drawing. As this occurs, the catch 107 is held fast in the illustrated position by a catch-spring (not shown).

As the hammer 13 is returned to the cocked position, as shown in the drawing, the projection 101 encounters the illustrated forward, inclined surface of the catch 107. The projection 101 presses the catch 107 out of its path against the force of the catch-spring, travels past the catch 107 up to the dead point, and returns to the illustrated position, seated on the underside of the catch 107.

The restraining lever 103 further has an opening through which is positioned the safety shaft 55. The upper, inside of this opening is provided with a cam projection which extends downward and in the ready-to-fire state shown, seats itself in a recess in the circumferential surface of the securement pin. If the safety shaft 55 is rotated into a "military" position, the circumferential surface of the safety shaft 55 engages the cam projection and thereby lifts the restraining lever 103 upward, so that the projection 101 and the catch 107 come out of engagement so that the reduction in pull resistance is no longer active.

The illustrated hammer release assembly, therefore, can be used to selectively reduce the trigger-pull of a hand-held firearm by simple and economical means. Specifically, the trigger-pull of a sport version of a military weapon is reduced while still retaining the established military construction and without additional precision craftsmanship or compromising the safety of the weapon.

In the illustrated example, the reduction of the trigger-pull force may be nullified by the activation of a manually accessible safety shaft 55. Thus it is possible for reservists to train with a hand-held firearm which resembles, as nearly as possible, a military weapon.

This nullification is achieved by moving the restraining lever 103 to a disengaged position. When in its disengaged position, the restraining lever 103 restrains the hammer 13 (but only when the hammer is in its cocked position), with a restraining force directionally counter to that of the hammer spring, but, having a magnitude less than the force of the hammer spring.

In its cocked position, the hammer 13 does not support itself by just the engaging stop 47 of the trigger lever 43, but also engages the restraining lever 103, so that less force is applied on the engaging stop 47 and correspondingly the friction force thereon is lessened. This is the friction force, which must be overcome to pull the trigger 33. Once the trigger 33 is pulled, the force of the hammer spring overcomes that of the restraining lever 103, and the restraining lever 43 rotates out of the hammer strike path allowing the hammer 13 to rotate without restrictions. Thus, the restraining lever 43 minimally impacts the effect of the hammer strike.

The restraining apparatus may optionally be a detent, which acts upon the cocked hammer 13 and which must be overpowered by the hammer's rotation either to or from the cocked position.

In order not to increase the force of cocking the hammer 13, which if increased in a self loading weapon could lead to functional disturbances, the restraining apparatus does not restrain the hammer 13 as it is rotated from the rest position into the cocked position. Upon release of the hammer 13, the restraining apparatus, could optionally be pressed into a holding latch, from which it is only released by the hammer 13 when fully cocked again.

In the illustrated example the restraining apparatus is a one-way catch which engages the hammer 13 while the hammer 13 is in the cocked position, but is simply overrun while the hammer 13 moves from the firing position into the cocked position.

A hand-held firearm possesses, as a rule, a security measure, which places the hammer 13 directly over the trigger 33 or somewhat indirectly over a trigger lever 43, if so present. In the case of a security measure of this type, a reliable, force transmitting contact between the hammer stop notch 19 and the trigger 33 (or the trigger lever 43) must exist. Therefore, the illustrated example allows the restraining apparatus to be inactivated when the firearm is in the "military" position. When the weapon is in this "military" mode, the entire force of the hammer spring is transferred by the notch 19 and trigger 33 (or by the trigger lever 43) to the safety apparatus and thereby the seating of the notch 19 is so affected by the added pressure that the weapon functions the same as in the case of a similarly constructed military weapon.

It is advantageous to, at times, completely set-aside the action of the restraining apparatus, in this fashion, so that the same trigger pull must be directly exerted as in the case of a military weapon. This allows marksmen such as reservists or hunters, who often encounter difficult terrain and don't want to set the safety on their weapons, to avoid the chance of a weapon discharge by, for example, a branch.

It is also possible to design an additional recess or notch on the hammer 13, into which the restraining apparatus can engage. In the case of the civil version of the military weapon, the same component which is provided for the military weapon, can be used, but in which the notch or recess is integrally machined.

Another possible approach affixes an additional, protruding projection on the hammer 13, which, is retrofitted on the mass-produced hammer 13. It is preferable however that the projection be one-piece construction with the hammer 13. The restraining apparatus, with this addition to the hammer 13, then comes into contact with no other section of the hammer 13, except with this projection. Alternatively, the hammer 13 could be something like the firing pin of a firing breaching, although it would be preferred that it remain the integral part of a hammer actuated breaching.

In yet another example, the restraining apparatus could be designed as a spring mounted detent sphere, which could be implanted in the hammer 13 itself. When the hammer 13 is in the cocked position, the lever, located outside the strike path lies against the hammer projection and acts against the force of the hammer spring. The location of the restraining apparatus within the military weapon could thus remain unchanged, since the finger lever and the hammer projection can be so positioned, as to make use of its clear space along the path of the hammer 13 in the existing military version. In this alternative approach, the projection on the hammer 13 cannot be centrally positioned, but must be placed to the side, where the free restraining finger lever is located. The restraining finger lever can be movably activated in its longitudinal direction by the restraining spring and pressed in a direction contrary to that of the hammer 13.

In still another example, the restraining lever 103 can be designed as a pivoted element, which is pivotally held in a bearing and on its other end, is secured by the restraining spring 105 in contact with the projection of the hammer 13. Such an arrangement is particularly resistant to dirt contamination.

In an additional example, the end of the restraining lever 43 in contact with the projection 101 is designed as a spring loaded detent cam, which engages the projection 101 of the hammer 13 in its cocked position, and rests thereon. If the hammer 13, and thus the projection 101, are moved in the cocking direction, then the restraining lever 103 runs without hindrance and passes by the detent cam, because this has snapped away against the force of a weak spring as the projection 101 approaches.

A hammer-actuated breech such as used for a military weapon possesses a transversely placed safety shaft 55, upon both ends of which, is respectively seated an activation knob, on the outside of the stock, by means of which the safety shaft 55 can be manually turned. This safety shaft 55 possesses a projection or a recess, which comes into engagement with an extension of the trigger, in order to make the trigger 33 immovable. The safety shaft 55 is, in this function, fixed in either position by a detent. The safety shaft can even further exhibit further "stop" positions, for instance, for continuous fire and for continuous fire with a limited number of shots.

In a further example, this safety shaft 55 may possess a circumferential notching arrangement for the restraining lever 103, which is pressed against the safety shaft 55 by the restraining spring 69. The purpose of this is so that the restraining lever 103, when in the position in which the firing or trigger apparatus is secured, is lifted out of contact with the projection of the hammer, whereby the above-mentioned advantages can be achieved.

Also further rotational positions for the safety shaft 55 can be provided, in the case of a civil weapon without continuous fire possibilities. This would be the third position, the "military" position, in which the restraining lever 103 is lifted out of engagement with the projection 101 of the hammer 13. Although the firing and trigger apparatuses are not secured, the trigger 33 achieves the trigger-pull of the corresponding military weapon, as well as a trigger-pull, which is not diminished by the action of the restraining apparatus 103.

While various examples have been described is this patent, the scope of this patent is not limited to those examples. On the contrary, the scope of this patent is defined by the appended claims.

What is claimed is:

1. For use with a firearm, a hammer release apparatus comprising:

a pivotably mounted hammer including a stop notch and a projection;

a hammer spring operably connected to the hammer for generating a rotational force biasing the hammer from a cocked position toward a firing position;

a pivotably mounted trigger having an engagement nose disposed at one end;

a trigger spring operably coupled to the trigger for biasing the trigger to a rest position, the trigger being actuatable against a force of the trigger spring from a rest position into a depressed position;

a pivotably mounted trigger lever having one end disposed to engage the stop notch of the hammer, and an opposed end disposed to engage the trigger engagement nose;

a pivotably mounted restraining apparatus having a catch disposed to restrainingly engage the projection of the hammer, the restraining apparatus shiftable between a first position in which only the trigger lever engages the hammer in the cocked position, creating a first pull resistance, and a second position in which the restraining apparatus and the trigger lever simultaneously engage the hammer in the cocked position, creating a second pull resistance lesser than the first pull resistance; and a restraining spring operably connected to the restraining apparatus and generating a force counter to the rotational force of the hammer spring.

2. A hammer release apparatus as defined in claim 1, wherein the restraining apparatus comprises a one-way catch that restrainingly engages the hammer upon movement of the hammer towards the firing position.

3. A hammer release apparatus as defined in claim 1, wherein the restraining apparatus may be rotated to separate the restraining apparatus and the projection of the hammer.

4. A hammer release apparatus as defined in claim 1, further comprising a safety shaft which is rotatable about an axis, the safety shaft having a position wherein the safety shaft prevents engagement between the restraining apparatus and the hammer.

5. A hammer release apparatus as defined in claim 1, further comprising a safety shaft which is rotatable about an axis, the safety shaft having a position wherein the safety shaft prevents the movement of the trigger into the depressed position.

6. A hammer release apparatus as defined in claim 1, further comprising a safety shaft which is rotatable about an axis, the safety shaft having a position wherein the safety shaft allows the engagement between the restraining apparatus and the hammer and allows the movement of the trigger into the depressed position.

7. A hammer release apparatus as defined in claim 1, further comprising a safety shaft which is rotatable about an axis, the safety shaft having a circumferential surface which raises the catch out of engagement with the projection of the hammer.

8. A hammer release apparatus as defined in claim 1, wherein the restraining spring pivots the restraining apparatus into engagement with the projection of the hammer when the hammer is in the cocked position, but pivots at least a portion of the retraining apparatus away from the projection, when the hammer is moved from the firing position toward the cocked position.

9. For use with a firearm, a hammer release apparatus comprising:

a pivotably mounted hammer including a stop notch, and a projection;

a pivotably mounted trigger having an engagement nose disposed at one end;

a hammer spring operably connected to the hammer for generating a rotational force biasing the hammer from a cocked position toward a firing position the hammer spring producing at least a portion of a pull resistance associated with the trigger;

a trigger spring operably coupled to the trigger for biasing the trigger to a rest position, the trigger being actuatable against a force of the trigger spring from a rest position into a depressed position;

a pivotably mounted trigger lever having one end disposed to engage the stop notch of the hammer, and an opposed end disposed to engage the trigger engagement nose;

a pivotably mounted restraining apparatus having a catch disposed to restrainingly engage the projection of the hammer, the restraining apparatus shiftable between a first position in which only the trigger lever engages the hammer in the cocked position, and a second position in which the restraining apparatus and the trigger lever simultaneously engage the hammer in the cocked position; and a restraining spring operably connected to the restraining apparatus and generating a force counter to the rotational force of the hammer spring to reduce the pull resistance when the restraining apparatus is in the second position.

10. An apparatus as defined in claim 9, wherein the restraining apparatus comprises a one-way catch that engages the hammer when the hammer is in the cocked position and the restraining apparatus is in the second position.

11. An apparatus as defined in claim 9, further comprising a safety shaft which is rotatable about an axis, the safety shaft having a position wherein the safety shaft prevents engagement between the restraining apparatus and the hammer.

12. An apparatus as defined in claim 9, further comprising a safety shaft which is rotatable about an axis, the safety shaft having a position wherein the safety shaft prevents the movement of the trigger into the depressed position.

13. An apparatus as defined in claim 9, further comprising a safety shaft which is rotatable about an axis, the safety shaft having a position wherein the safety shaft allows the engagement between the restraining apparatus and the hammer and allows the movement of the trigger into the depressed position.

* * * * *